US007115836B2

(12) United States Patent
Yoshikawa et al.

(10) Patent No.: US 7,115,836 B2
(45) Date of Patent: Oct. 3, 2006

(54) GLOW PLUG

(75) Inventors: Takaya Yoshikawa, Nagoya (JP); Shinya Murakoshi, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/166,280

(22) Filed: Jun. 27, 2005

(65) Prior Publication Data

US 2005/0284860 A1 Dec. 29, 2005

(30) Foreign Application Priority Data

Jun. 29, 2004 (JP) ..... 2004-190821

(51) Int. Cl.
*F23Q 7/22* (2006.01)

(52) U.S. Cl. ..... 219/270

(58) Field of Classification Search ..... 219/270, 219/267, 538, 260; 431/258, 259, 260, 261, 431/262, 263, 264, 265, 266
See application file for complete search history.

(56) References Cited

U.S. PATENT DOCUMENTS 6,130,410 A * 10/2000 Kita ..... 219/270
6,396,028 B1 * 5/2002 Radmacher ..... 219/270
6,483,079 B1 * 11/2002 Sato et al. ..... 219/270
6,610,964 B1 * 8/2003 Radmacher ..... 219/270
6,660,970 B1 * 12/2003 Geissinger et al. ..... 219/270
6,710,305 B1 * 3/2004 Lindemann et al. ..... 219/270
6,759,631 B1 * 7/2004 Geissinger et al. ..... 219/270
6,831,253 B1 * 12/2004 Taniguchi et al. ..... 219/270
6,958,462 B1 * 10/2005 Unno et al. ..... 219/444.1

FOREIGN PATENT DOCUMENTS

JP 11-270849 10/1999
JP 2003-56848 2/2003
JP 2003-130349 5/2003

* cited by examiner

*Primary Examiner*—Daniel Robinson
(74) *Attorney, Agent, or Firm*—Stites & Harbison PLLC; Ross F. Hunt, Jr.

(57) ABSTRACT

A glow plug comprising: a ceramic heater which houses a heating element defined herein in a tip end side of said ceramic heater, and which elongates in an axial direction; a cylindrical metal shell which has a shaft hole, which houses a rear end portion of said ceramic heater in said shaft hole, and which holds said ceramic heater in said shaft hole directly or via another member; and a center pole including a center-pole rear end portion as defined herein and a center-pole tip end portion as defined herein, said ceramic heater being mechanically rigidly joined to said heater connecting portion, wherein a stress releasing portion in which a diameter is smallest in an area between said heater connecting portion and said center-pole rear end portion is formed in said center pole.

12 Claims, 8 Drawing Sheets

GLOW PLUG

FIELD OF THE INVENTION

The present invention relates to a glow plug which is used for preheating a diesel engine, or heating liquid, gas, or the like.

BACKGROUND OF THE INVENTION

Conventionally, there are various types of glow plugs. Examples of such glow plugs are a metal glow plug in which a heater is configured by housing a heating coil in a tip end portion of a bottomed cylindrical metal pipe, and a ceramic glow plug using a ceramic heater in which an insulative ceramic is used as a substrate of the heater, and a heating element made of a conductive ceramic is embedded in the substrate. All of such glow plugs are used in, for example, preheating of a diesel engine. Conventionally, a glow plug is used with being attached to an engine in a manner where a heating portion at the tip end of a heater is projected into a sub-combustion chamber.

Recently, a demand for a ceramic glow plug among such glow plugs is particularly growing in accordance with a request for high-temperature resistance because of enhancement of the engine performance.

As shown in FIG. 7, for example, such a ceramic glow plug comprises: a ceramic heater 130; a metal shell 110 having a thread portion for attachment to an engine head; an outer cylinder 160 which holds the pressingly inserted ceramic heater 130; a pin terminal 170 through which an electric power is supplied from the outside to the ceramic heater 130; a center pole 120; a lead coil RC; an insulating member 140 which ensures insulation between the center pole 120 and the metal shell 110; and an O-ring 150 which is pressed against the insulating member 140 to maintain an airtight seal of the interior of the metal shell 110 (see JP-A-2003-56848).

In the thus configured glow plug, a cord for supplying a power from a battery which is not shown is connected to the pin terminal 170 in the rear end of the glow plug. The power is conducted through the center pole 120, the ceramic heater 130, the outer cylinder 160, the metal shell 110, and the engine head or the ground. In the glow plug having this configuration, even when the combustion pressure from the combustion chamber which is due to combustion in the engine acts on the ceramic heater 130 toward the rear end in the axial direction, the lead coil RC can relax a stress of the ceramic heater. Therefore, the ceramic heater 130 and the center pole 120 can be prevented from being destroyed or damaged.

In another configuration, in place of the lead coil RC, a cylindrical member 121 such as shown in (b) of FIG. 7 is used, and the center pole 120 and the ceramic heater 130 are mechanically rigidly connected to each other in a direct manner. It is described that, according to the configuration, even when the thickness of the cylindrical member 121 is decreased in order to reduce the diameter of the glow plug (particularly, in the case where the diameter of the thread portion of the metal shell is not larger than M8), a predetermined sectional area can be obtained, and therefore insulation can be maintained while ensuring the gap between the heater 130 and the metal shell 110, without forming the heater into a step-like shape (see JP-A-2003-130349).

SUMMARY OF THE INVENTION

In the structure disclosed in JP-A-2003-130349, a configuration which is not problematic in the structure of JP-A-2003-56848 becomes obvious. That is, in the case where the heating element is a ceramic heater, particularly, when the combustion pressure from the combustion chamber acts on the ceramic heater, there is a possibility that the ceramic heater is destroyed or damaged because the cylindrical member has no configuration for relaxing a stress unlike the lead coil of the conventional art.

On the other hand, there is another problem. The ceramic heater and the center pole are mechanically rigidly connected to each other. When the cord connected to a terminal portion configured by a pin terminal or the like vibrates, therefore, a force due to the weights of the cord and the pin terminal acts on the center pole. Consequently, the case where the center pole is broken possibly may occur.

In such a glow plug, it is not easy to coaxially join the center pole with the cylindrical member in the production process, and therefore the center pole is often inclined with respect to the cylindrical member and the ceramic heater as shown in (a) of FIG. 8. This phenomenon is remarkable particularly in the case where the joining is conducted by means of laser welding. In laser welding, the periphery of a portion where the center pole is fitted into the cylindrical member is irradiated with a laser beam to weld them together. Therefore, the welding is conducted by either of the methods where the center pole and the cylindrical member are integrally rotated, and where the laser irradiation port revolves. In both the methods, the process of welding the center pole and the cylindrical member is started at a certain one point, and gradually advances in a revolving manner. In the course of welding, therefore, the center pole and the cylindrical member are sometimes welded while their axes O are inclined to each other.

When the members are assembled under the condition that joining is conducted in a non-coaxial manner, the coaxialities between the members, i.e., the center pole, and the cylindrical member and the ceramic heater are lost, and the members are inclined. In this case, when the members are assembled to the metal shell, assembling must be conducted while applying a stress (center-pole correcting force F) is applied in the direction along which the inclination of the center pole is corrected, i.e., a direction perpendicular to the center pole ((b) of FIG. 8) so that the members are coaxial. When assembling is conducted in this way, the force F for correcting the inclination of the center pole acts not only on the center pole but also on the ceramic heater, and hence there arises a problem in that the ceramic heater is damaged or broken also in the production process.

The invention has been conducted in view of the above-discussed problems. It is an object of the invention to provide a glow plug which is configured so that a ceramic heater and a center pole are connected to each other by a cylindrical member, and in which, even when a force acts on the glow plug during the production process or the use, the ceramic heater and the center pole can be prevented from being damaged.

In order to attain the object, the glow plug of the invention is a glow plug comprising:

a ceramic heater (preferably the ceramic heater has a rod-like shape (rod-shaped ceramic heater)) which includes a heating element provided in a tip end side of the ceramic heater, the heating element being capable of generating heat upon energization;

a cylindrical metal shell which has a shaft hole, which houses a rear end portion of the ceramic heater in the shaft hole, and which holds the ceramic heater in the shaft hole directly or via another member; and a center pole including:

a terminal portion provided in a rear end of the center pole, the terminal portion being to be supplied with an electric power from an outside directly or via another member;

a heater connecting portion having a hole provided in a tip end of the center pole, a rear end portion of the ceramic heater being mechanically rigidly fitted into the hole; and a stress releasing portion having the smallest diameter in an area between the heater connecting portion and the terminal portion.

The second preferable configuration of the glow plug is characterized in that the heater connecting portion includes a cylindrical member and a center-pole fitting portion fitted into the cylindrical member.

In a configuration where the ceramic heater and the center, pole are mechanically rigidly connected to each other by the cylindrical member, a stress which is caused to act on the ceramic heater by the combustion pressure, a stress which acts on a terminal portion from the outside, or a center-pole correcting force which is produced during the production process acts on the whole center pole-ceramic heater joint body. The first preferable configuration of the invention prevents the ceramic heater and the center pole from being damaged by these stresses. That is, the disposition of the stress releasing portion in the center pole enables the stresses to be relaxed by bending of the stress releasing portion, thereby eliminating the possibility that the ceramic heater is broken. Therefore, the occurrence of damages in the ceramic heater and the center pole can be reduced or suppressed.

The third preferable configuration of the glow plug is characterized in that the center pole includes a center-pole front large-diameter portion provided in an area between the heater connecting portion and the stress releasing portion, the center-pole front large-diameter portion having a larger diameter than that of the stress releasing portion.

The disposition of the center-pole front large-diameter portion having a large diameter on the rear end side of the center-pole fitting portion achieves the following effect particularly when the center pole and ceramic heater are connected to each other with using the cylindrical member. The stress releasing portion, i.e., the bending portion can be remote from the portion which is fitted into the cylindrical member. Therefore. it is possible to avoid disjoining from the center-pole fitting portion due to deformation of the cylindrical member which is caused when the bending portion of the center pole is close to the portion fitted into the cylindrical member.

The center-pole fitting portion can be joined to the cylindrical member by press fitting or welding to the cylindrical member. When the length along which they butt against each other in the joining (hereinafter, referred to as joining length) is not constant, there arises the following problem. In the case where the joining length is short or insufficient, for example, there is a possibility that, when a stress is applied to the center pole, the cylindrical member and the center pole are disjoined, and the electrical conduction is not ensured. By contrast, in the case where the pressing insertion length is excessive, when the center-pole fitting portion is pressingly inserted or the combustion pressure is applied, the tip end face of the center pole presses the rear end face of the ceramic heater, thereby causing the ceramic heater to be damaged, or lead portions of the heater to be short-circuited. As a result, there arises a possibility that the ceramic heater cannot function as a heater.

The fourth preferable configuration of the glow plug is characterized in that the center pole includes: a center-pole front large-diameter portion having a larger diameter than that of the center-pole fitting portion, and a positioning end face, against which a rear end face of the cylindrical member butts, provided between the center-pole front large-diameter portion and the center-pole fitting portion.

Since the positioning end face is formed as described above, the center-pole fitting portion which is joined to the cylindrical member can be ensured to have a predetermined joining length. Therefore, the joining length is neither too long nor too short, and the cylindrical member and the center pole can be easily positioned and joined to each other during the production process.

In the case where the cylindrical member and the center pole are joined to each other, preferably, the cylindrical member includes a portion which is adjacent to the center-pole front large-diameter portion, the portion having an outer diameter substantially equal to that of the center-pole front large-diameter portion. When the outer diameter is changed in the joined portions of the two members, stresses are concentrated in an area where the outer diameter is changed, thereby causing a possibility that they are disjoined. This problem can be avoided by making the joined portions of the two members substantially identical with each other. When this joining is conducted by laser welding, particularly, it is possible to achieve also an effect that the weld strength is improved.

Preferably, the outer circumferential face of the cylindrical member has a substantially uniform outer diameter in any portion along the axial direction. Since the cylindrical member holds the ceramic heater on the inner circumferential face of itself and is housed in the shaft hole of the metal shell, the thickness of the cylindrical member is inevitably thinner than that of the metal shell or the like. In a configuration where the outer circumferential face of the cylindrical member which is thin is changed in outer diameter in the axial direction (for example, a configuration having a portion in which the outer diameter is changed as in the cylindrical member disclosed in JP-A-2003-56848), stresses are concentrated in an area where the outer diameter is changed. Consequently, there is a possibility that the cylindrical member is broken in the area. Furthermore, the joining area with respect to the center pole is narrowed. When the joining is conducted by welding, the strength of the joined portion is reduced by the thermal history due to welding, and hence there is also a possibility that the portion breaks. Also when the joining is conducted not by welding but by squeezing or the like, the above-described configuration is preferable in view of the fact that slipping may occur because of the reduced joining area.

Even when the stress releasing portion in the invention is disposed at any position of the center pole, it is possible to attain the effects. However, it is particularly preferable to form the stress releasing portion on a tip end side with respect to the midpoint in the axial direction of the center pole.

As described above, the stress releasing portion is formed in a portion of the center pole which is close to the ceramic heater. Even when the coaxiality between the ceramic heater and the center pole is maximumly deviated by a degree at which no problem is produced in the use of the glow plug, it is possible to prevent a situation where the center pole is in contact with the hole in the metal shell to cause a short circuit, from occurring. Furthermore, it is possible to prevent more effectively the ceramic heater which has a low breaking resistance, from being damaged. In view of the phenomenon that a stress acts on the whole center pole-ceramic heater joint body, it is preferable that the stress releasing portion is formed so as to include the midpoint of the whole length of the center pole-ceramic heater joint body.

A rear end portion of the center pole has a predetermined outer diameter in order to prevent the portion from being broken when a stress due to the combustion pressure or vibrations acts on the center pole. Therefore, the stress releasing portion is smaller in diameter than the center-pole rear end portion. The small-diameter stress releasing portion and the large-diameter center-pole rear end portion may have a configuration where a tip end-oriented end face is formed between them and their outer diameters are suddenly changed. However, it is preferable to employ another configuration having a tip end-oriented inclined face in which the diameter is more gradually increased as further advancing toward the rear end. According to the configuration, since the tip end-oriented inclined face is formed, a load due to a stress acting on the center pole is dispersed to the tip end-oriented inclined face, and hence the breaking resistances of the center pole and the ceramic heater can be further improved.

Similarly, in order to prevent the outer diameter of the center pole from being suddenly changed, and to disperse a load due to a stress acting on the center pole, it is preferable to employ a configuration having a rear end-oriented inclined face which is adjacent to the tip end side of the stress releasing portion, and in which the diameter is more increased as further advancing toward the tip end in the axial direction.

Of course, it is more preferable that the tip end-oriented inclined face and the rear end-oriented inclined face are simultaneously formed. In the case where both the inclined faces are simultaneously formed, when an acute angle formed by the tip end-oriented inclined face of the center pole with respect to the axis of the center pole is $\alpha$, and an acute angle formed by the rear end-oriented inclined face of the center pole with respect to the axis is $\beta$, it is preferable to satisfy a relationship of $\alpha<\beta$. According to the configuration, the stress releasing portion can be formed in a portion which is close to the ceramic heater with respect to the midpoint of the center pole. Furthermore, it is possible to realize a structure where the rear end side with respect to the midpoint of the center pole is thicker and higher in rigidity than the tip end side including the stress releasing portion. Also when a stress is applied to the center pole by vibrations of a pin terminal or a cord, therefore, it is possible to effectively avoid breakage of the center pole.

When the rear end side of the stress releasing portion is formed as the above-described tip end-oriented inclined face, preferably, the positional relationship of an O-ring disposed in the metal shell and the tip end-oriented inclined face is set so that the tip end-oriented inclined face is completed in a portion which is on the tip end side with respect to the position where the O-ring is placed. According to the configuration, a surface pressure which is to be applied in order to maintain the airtight seal from the O-ring to the outer circumferential face of the center pole and the inner circumferential face of the metal shell can be equally applied to the respective faces.

When an O-ring is fitted between the inner circumferential face of the metal shell and the outer circumferential face of the center pole to maintain the airtight seal, for example, the center pole is formed so that the two faces are opposed to each other in parallel. When an O-ring is fitted between three faces of the inner circumferential face of the metal shell, the outer circumferential face of the center pole and the tip end face of an insulating member, the outer circumferential face of the center pole is formed so that surface pressures applied to the respective faces of the O-ring are substantially equal to each other. Namely, it is not required to form the stress releasing portion in the center pole so as to extend to a portion of the center pole against which the O-ring butts, and a design in which emphasis is placed on airtightness can be employed in the portion of the center pole against which the O-ring butts.

DESCRIPTION OF REFERENCE NUMERALS AND SIGNS

Figure 1:
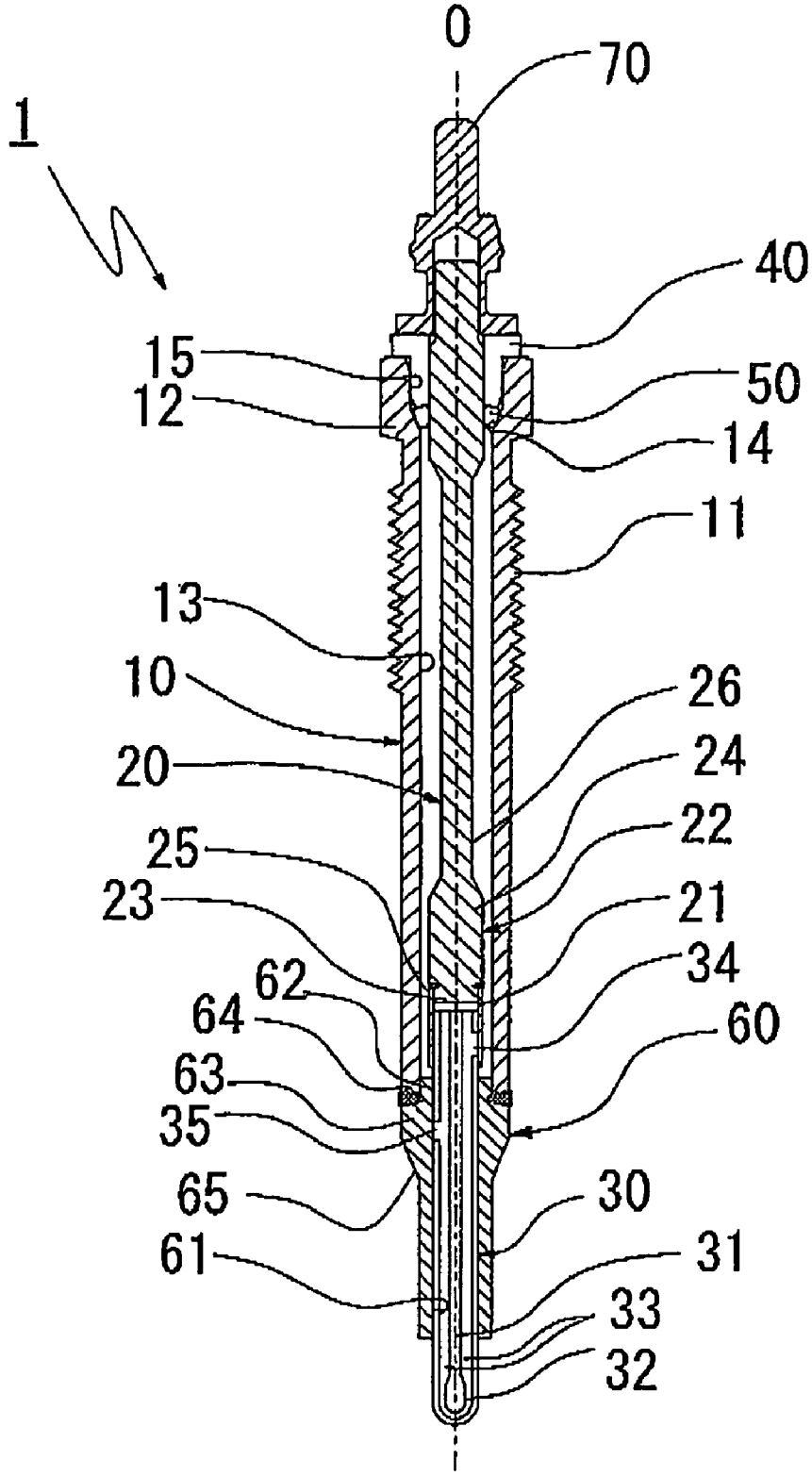
FIG. 1 is a sectional view showing the whole of a glow plug 1 of an embodiment of the invention.

1 glow plug
10 metal shell
14 metal-shell taper
20 center pole
21 cylindrical member
25 positioning end face
26 stress releasing portion
30 ceramic heater
40 insulating member
50 O-ring
60 outer cylinder
70 pin terminal

DETAILED DESCRIPTION OF THE INVENTION

Hereinafter, the glow plug of the invention will be described with reference to the accompanying drawings.

FIG. 1 is a half-sectional view showing the whole of a glow plug 1 of an embodiment of the invention. The glow plug 1 is approximately configured by a combination of a metal shell 10, a center pole 20, a ceramic heater 30, an insulating member 40, an O-ring 50, an outer cylinder 60, and a pin terminal 70.

The members will be described in detail.

The rod-like center pole 20 in which one end is protruded to the rear end side is housed in the inner circumference side of the cylindrical metal shell 10. The ceramic heater 30 is connected to the tip end side of the center pole 20. The outer cylinder 60 is joined to a tip end portion of the metal shell 10, and the ceramic heater 30 is held by the outer cylinder 60. By contrast, in a rear end side of the metal shell 10, the O-ring 50 and the insulating member 40 are inserted into a gap between the center pole 20 and the metal shell 10, and, in the rear end side of the insulating member 40, the pin terminal 70 circumferentially fixes the center pole 20. Ideally, the axes of all the members are on the same axis or the axis O.

The metal shell 10 has a cylindrical shape made of a steel material equivalent to S45C. On the outer circumferential face of the metal shell, formed are a male thread 11 for attachment to a diesel engine (not shown), and a tool engagement portion 12 with which a mounting tool is to be engaged. By contrast, a shaft hole 13 is formed in the inner circumference of the metal shell. In a rear end portion of the hole, formed are a metal-shell taper 14 which more increases the diameter of the shaft hole 13 as further advancing toward the rear end, and a large-diameter hole 15 which is adjacent to the further rear end side of the metal-shell taper 14.

The center pole 20 has a rod-like shape. A center-pole fitting portion 23 which is fitted into a cylindrical member 21 for conduction with the ceramic heater 30 is formed in a tip end portion of the center pole. A center-pole front large-diameter portion 24 is formed on the rear end side of the center-pole fitting portion 23. A positioning end face 25 is formed between the center-pole fitting portion 23 and the center-pole front large-diameter portion 24. The rear end face of the cylindrical member 21 butts against the positioning end face 25 to be joined thereto. The rear end side of the center-pole front large-diameter portion 24 comprises a stress releasing portion 26 which is smaller in diameter than the center-pole front large-diameter portion 24, and has a structure in which, when a stress is applied to the center pole 20, the stress releasing portion 26 bends to prevent the ceramic heater 30 and the center pole 20 from being damaged or broken.

The ceramic heater 30 has a structure in which a heating element 32 and lead portions 33 made of a conductive ceramic are embedded in a rod-like insulative ceramic substrate 31. The heating element 32 positioned on the tip end side in the ceramic heater 30 is formed by a conductive ceramic into an approximately U-like shape, and the two lead portions 33 which rearward elongate from basal ends of the heating element 32 are formed. In one of the lead portions 33, an electrode lead-out portion 34 is exposed from the surface of the ceramic substrate 31 so that a rear end portion of the ceramic heater 30 is electrically conductive to the cylindrical member 21. In the other lead portion, an electrode lead-out portion 35 is similarly formed so as to be electrically conductive to the outer cylinder 60 on the tip end side with respect to the electrode lead-out portion 34.

The outer cylinder 60 has a cylindrical shape made of a stainless steel. A shaft hole 61 in which the ceramic heater 30 is pressingly inserted to be held is formed inside the outer cylinder, and the inner circumferential face of the shaft hole 61 is in contact with the electrode lead-out portion 35 to be electrically conductive thereto. The rear end of the outer cylinder 60 is formed as a small-diameter portion 62 which is fitted into the metal shell 10. On a tip end side of the small-diameter portion 62, a flange 63 is radially protruded with forming a rear end-oriented end face 64 between the flange and the small-diameter portion 62. A taper 65 in which the diameter is more reduced as further advancing toward the tip end is formed in the tip end side of the flange. The taper 65 functions as a sealing portion which ensures airtightness of a combustion chamber when attached to a diesel engine (not shown).

A terminal portion to which a cord for supplying an electric power from an external power source (not shown) is connected is formed in a rear end portion of the glow plug 1. In the terminal portion, the pin terminal 70 is circumferentially squeezed so as to surround the center pole 20 which is projected toward the rear end from the rear end face of the metal shell 10, and the pin terminal 70 constitutes the terminal portion.

The above-described members are produced and assembled in the following manner, thereby constituting the glow plug 1.

The heating element 32, the lead portions 33, and the electrode lead-out portions 34 and 35 are integrally injection molded from a raw material or a conductive ceramic powder, and prepared as a heat body powder compact. By contrast, as the ceramic substrate 31, split compacts are previously formed by die-press molding an insulative ceramic powder serving as a raw material. Each of the split compacts has a recess for housing the heat body powder compact, in a mating face of the split compact ((a) of FIG. 2). The heat body powder compact is sandwiched in the recesses of the split compacts to be housed therein, and then compressed. Thereafter, a debinding process, and a firing step such as hot press are conducted. The outer circumferential face is polished to be shaped into a cylindrical shape, thereby obtaining the ceramic heater 30 shown in (b) of FIG. 2.

The cylindrical member 21 is formed by shaping a steel material such as stainless steel into a pipe-like shape, and the inner diameter of the cylindrical member is set to be slightly larger than the outer diameter of the ceramic heater 30. Similarly, the outer cylinder 60 is shaped so that the diameter of the inner hole 61 of the outer cylinder is slightly larger than the outer diameter of the ceramic heater 30. In the cylindrical member 21 and the outer cylinder 60 which are to be fitted onto the outer circumference of the ceramic heater 30, the inner circumferential faces are plated by Cu, Au, or the like which has excellent oxidation resistance, for the purposes of reduction of the press-fitting load, and prevention of oxidation of the electrode lead-out portions 34, 35 which are exposed from the surface of the ceramic heater 30. The rear end of the cylindrical member 21 is laser-welded to the center pole 20. Therefore, a portion which is to be fused in the welding (specifically, a portion which is in the rear end face of the cylindrical member 21, and which butts against the positioning end face 25 of the center pole 20) is not always necessary to be plated. The inner diameter of the cylindrical member 21, and the diameter of the inner hole 61 of the outer cylinder 60 are adequately set so that the ceramic heater 30 can be pressingly inserted and held. In the embodiment, since the diameters are slightly reduced by plating, the diameters are slightly larger than the outer diameter of the ceramic heater 30.

The one electrode lead-out portion 34 of the lead portions 33 is fittingly held by press fitting, interference fitting, or the like on the inner circumferential face of the cylindrical member 21 so as to be electrically connected thereto. Similarly, in order to establish the electrical connection of the electrode lead-out portion 35, the outer cylinder 60 is fitted onto the outer circumference of the ceramic heater 30 by press fitting, interference fitting, or the like, to integrate the ceramic heater 30, the outer cylinder 60, and the cylindrical member 21 ((c) and (d) of FIG. 2). (Hereinafter, the integrated member is referred to as heater integrated member).

By contrast, the center pole 20 is formed by plastic working, cutting, or the like from a rod member of a steel material which is cut into a predetermined dimension. The center-pole fitting portion 23 which is to be joined to the cylindrical member 21 is formed in one end of the rod member, and a portion which is to be inserted into the pin terminal 70 is worked to a small diameter or knurled in the other end. The portion is to be joined to the pin terminal 70 which is formed as a separate member, to constitute a terminal portion.

Since the center-pole fitting portion 23 is formed in the tip end of the center pole 20, the positioning end face 25 which is an interface with the center-pole front large-diameter portion 24 is formed in the rear end side. The formation of the positioning end face 25 ensures the axial length of the center-pole fitting portion 23, thereby eliminating a problem that the joining strength is reduced because of an insufficient press-insertion length of the center-pole fitting portion 23 in the case where the cylindrical member 21 and the center pole 20 are joined together in a subsequent step. Moreover, a phenomenon in which the cylindrical member 21 is excessively inserted onto the center-pole fitting portion 23 can be avoided.

A small-diameter portion which is to function as the stress releasing portion 26 is formed in the rear end side of the center-pole front large-diameter portion 24. The diameter of the stress releasing portion 26 is smaller than that of the center-pole front large-diameter portion 24. The diameter of the stress releasing portion has a value which is sufficient for preventing the center pole 20 from being ruptured by a stress acting on the center pole 20 due to vibrations. The formation of the center-pole front large-diameter portion 24 facilitates the joining of the cylindrical member 21 and the center pole 20, and eliminates a weak portion in the vicinity of the joined portion. Even when a stress is applied to the center pole 20, therefore, it is possible to prevent disjoining from occurring in the portion. The working of the center pole 20 can be conducted by, for example, a cuffing work by a lathe. Preferably, the area where the stress releasing portion 26 is formed is on the tip end side with respect to the midpoint of the center pole 20. According to the configuration, even when the coaxiality of the welding between the cylindrical member 21 and the center pole 20 is relatively largely deviated, it is possible to prevent a situation where the center pole 20 is in contact with the inner wall forming the inner hole 13 of the metal shell 10 to be electrically conductive thereto, from occurring.

Figure 2:
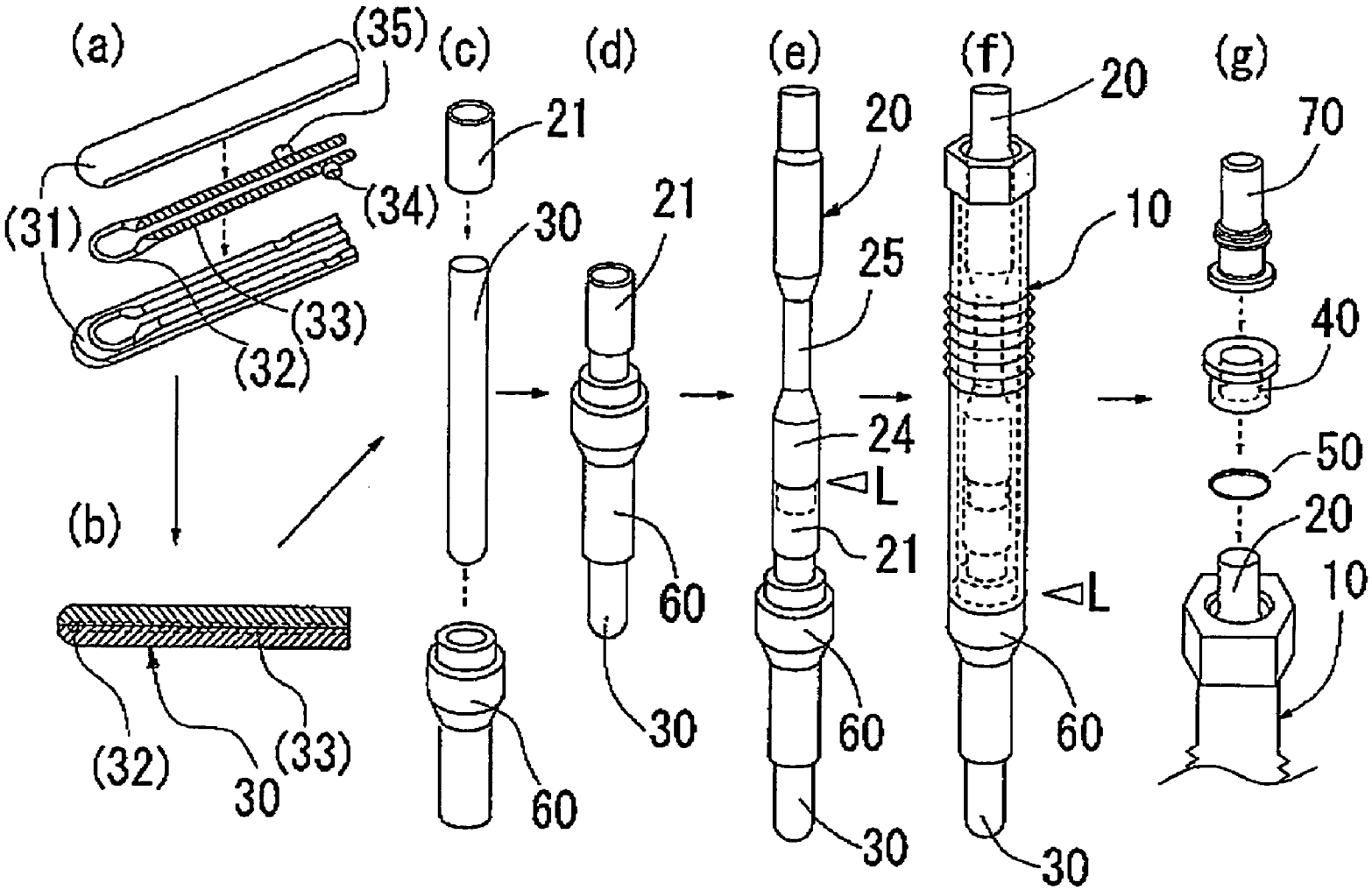
FIG. 2 is a view schematically showing a production process of the glow plug 1 of the embodiment of the invention.

The thus produced center pole 20, and the above-mentioned heater integrated member are laser-welded (L in the figure) ((e) of FIG. 2). In the welding, a welding process may be conducted in a state where the center-pole fitting portion 23 is pressingly inserted into the cylindrical member 21, and the positioning end face 25 of the center pole 20 is pressed against the rear end face of the cylindrical member 21. According to such welding, the joining can be conducted while deviation of the coaxiality between the center pole 20 and the heater integrated member is suppressed to a minimum degree. As a result of this joining process, the cylindrical member 21 and the center pole 20 are integrated with each other, to form a heater connecting portion where the heater is held.

From the viewpoint of the laser welding of the center pole 20 and the cylindrical member 21, it is preferable that the outer diameter of the center-pole front large-diameter portion 24 is substantially equal to that of the cylindrical member 21. When the butting faces of the members are laser-welded in the state where the diameters of the members are substantially equal to each other, the substantial equalization of the outer diameters of the members can enhance the joining strength, and improve the coaxiality between the center pole 20 and the cylindrical member 21.

Figure 3:
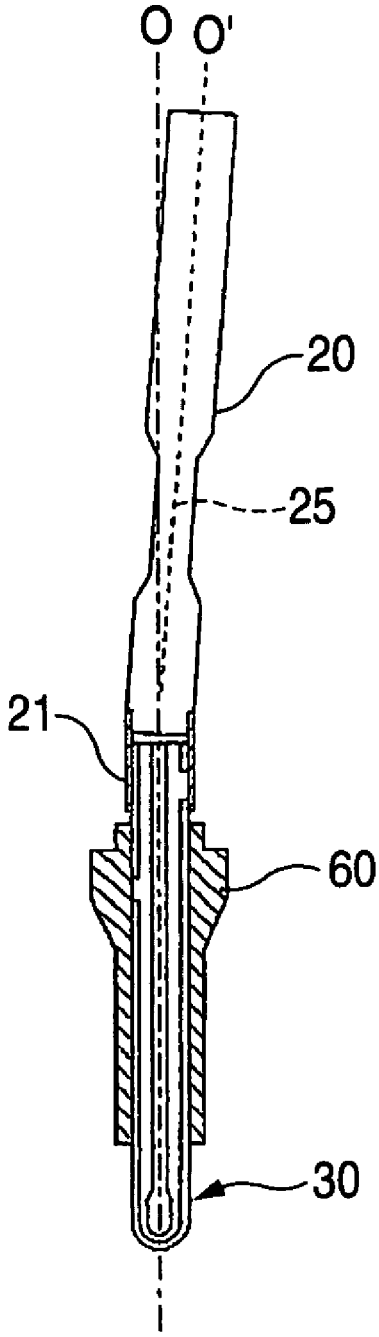
FIG. 3 is a view showing a heater joint body in which correction of the coaxiality that is one of effects of the invention is to be conducted.

After the center pole 20 is joined to the heater integrated member in this way, the heater integrated member is inserted into the inner hole 13 of the metal shell 10 with starting from the rear end of the center pole 20 ((f) of FIG. 2). In the case where deviation occurs in the coaxiality between the heater integrated member and the center pole 20 (FIG. 3), the heater integrated member may be passed through the inner hole 13 of the metal shell 10 while pressing the center pole 20 in a direction perpendicular to the axis (while bending the center pole 20 to make an axis O' coincident with the axis O). Even when axial deviation of between the heater integrated member and the center pole 20 is corrected as described above, the disposition of the stress releasing portion 26 in the center pole 20 can prevent the ceramic heater 30 from being damaged. Then, the tip end face of the metal shell 10 is caused to butt against the rear end-oriented end face 64 of the outer cylinder 60, and joined by laser welding to the small-diameter portion 62 of the outer cylinder 60.

Thereafter, the center pole 20 is passed through the inner holes of the O-ring 50 and the insulating member 40, and the pin terminal 70 is fitted to the rear end of the center pole 20, thereby obtaining the structure shown in (g) of FIG. 2. The insulating member 40 is pressed toward the tip end in the axial direction, and the pin terminal 70 is radially squeezed to integrate the members constituting the glow plug 1, thereby completing the glow plug.

Next, the function and effect of the stress releasing portion in the invention will be verified.

In the embodiment, the following four specimens were formed for verification. Namely, four kinds of $\phi 3.6 \times L15.0$, $\phi 2.5 \times L2.0$, $\phi 2.5 \times L15.0$, and $\phi 2.0 \times L2.0$ ($\phi$ indicates the diameter of the stress releasing portion 26, and L indicates the axial length of the stress releasing portion 26) were prepared. The center pole is pressingly inserted into the cylindrical member 21 while the diameter of the center pole is set to $\phi 4.0$, the axial length of the center-pole front large-diameter portion 24 is set to 6 mm, the diameter of the center-pole fitting portion 23 is set to $\phi 3.3$, and the axial length is set to 1.3 mm, and then joined thereto by laser welding. As comparative examples, a center pole which has a substantially uniform diameter over the range from the center-pole front large-diameter portion 24 to a portion onto which the pin terminal 70 is fitted was used. In the verification test, in order to produce a situation which is severer than a case where a glow plug is actually attached to an engine, the test is conducted with using the specimens in each of which, in order to set the rear end side of the center pole 20 as a free end, the center pole has not yet been attached to the metal shell 10 ((e) of FIG. 2).

Figure 4:
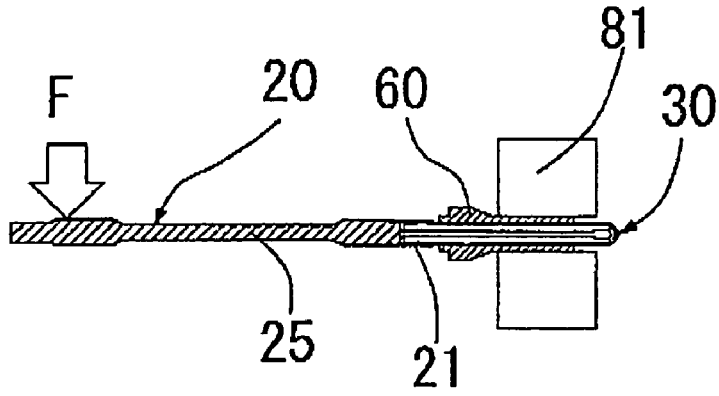
FIG. 4 is a diagram showing a test for verifying the effects of the invention.
Figure 5:
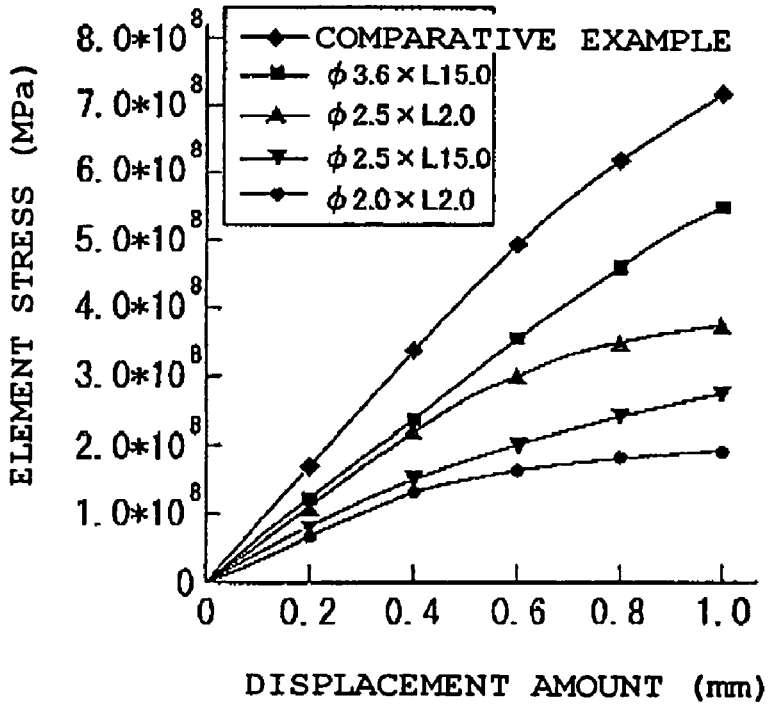
FIG. 5 is a view showing results of the test.

The verification is conducted by securing the outer cylinder 60 to a fixing jig 81 as shown in FIG. 4, applying a load F in a direction perpendicular to the center pole at a point which is separated by about 50 mm from the rear end of the center pole, and checking correlations between a displacement amount in the direction and the load F. FIG. 5 shows results of the test while the abscissa indicates the displacement amount, and the ordinate indicates a load or a stress acting on an element. From FIG. 5, it can be ascertained that, in the case where the stress releasing portion in the invention is provided, even when the displacement amount in the direction perpendicular to the center pole is increased, i.e., when a large stress acts in the direction, the breaking resistance of the ceramic heater is remarkably improved as compared with the comparative examples of the conventional art.

In the thus formed glow plug 1, the connection between the center pole 20 and the ceramic heater 30 is performed by, in place of the lead coil RC of the conventional art, a configuration in which the connection is conducted mechanically rigidly, such as that in which the cylindrical member 21 is used. Even in a structure in which a stress on the ceramic heater 30 and the center pole 20 acts directly on the ceramic heater 30, therefore, the stress can be relaxed by the stress releasing portion 26 disposed in the center pole 20. Consequently, it is possible to suppress or prevent the ceramic heater 30 from being damaged.

Figure 6:
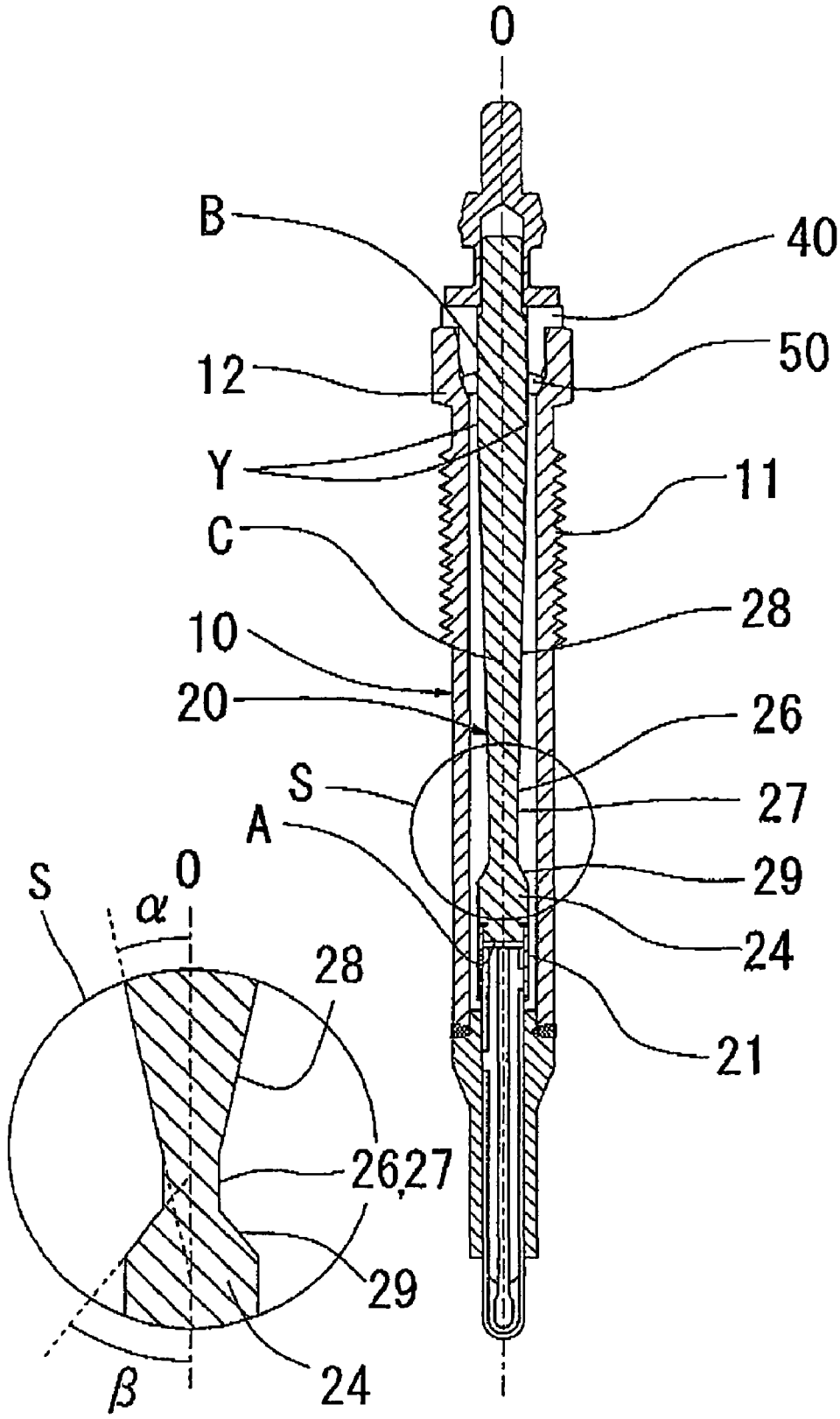
FIG. 6 is a sectional view of the whole of a glow plug 1 showing a modification of the invention.
Figure 7:
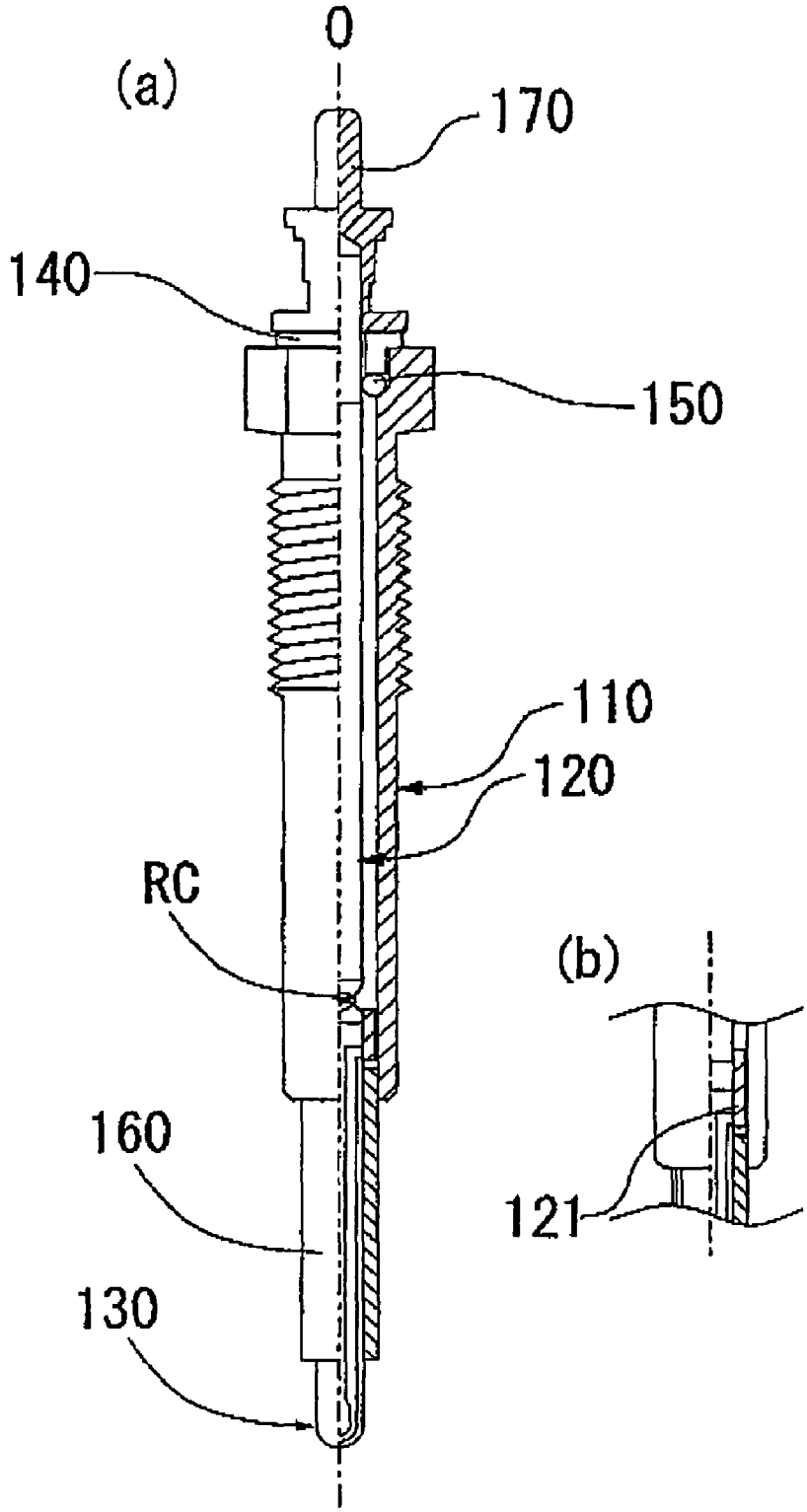
FIG. 7 is a view showing a conventional glow plug.
Figure 8:
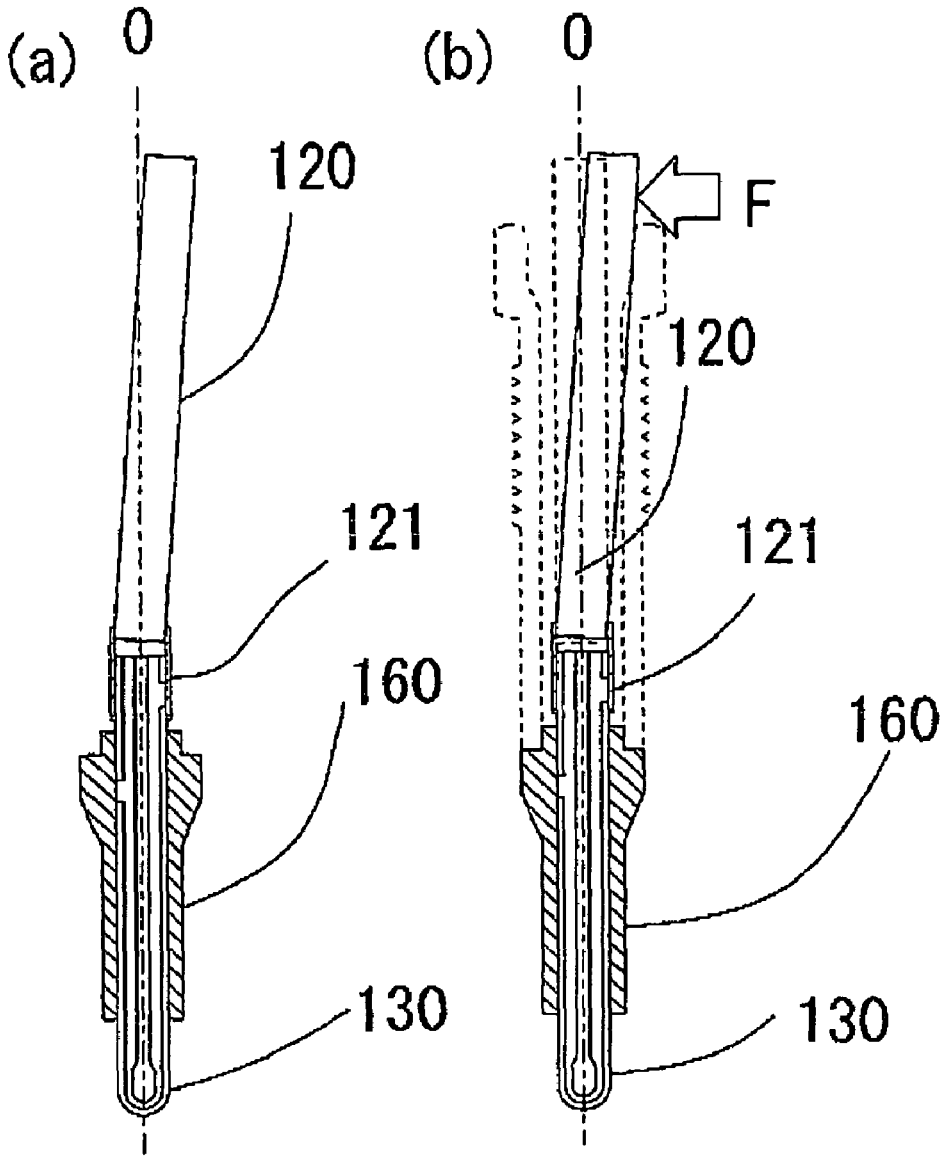
FIG. 8 is a view showing main portions of a problem in the conventional glow plug.

Alternatively, the invention may be formed in the following manner. The components which are not particularly changed from the embodiment are denoted by the same reference numerals or the reference numerals are omitted. As shown in FIG. 6, the center pole may be formed so as to have a so-called bat-like shape in which the stress releasing portion 26 formed in the center pole 20 is configured by a smallest-diameter portion 27 and a tapered tip end-oriented inclined face 28. In the alternative, the tip end-oriented inclined face 28 is formed in a range to a position which, as viewed in the axial direction, is separated toward the tip end from the O-ring 50 placed in the tool engagement portion 12 of the metal shell 10 (in the embodiment, a point Y which is on the tip end side with respect to the O-ring 50). As described above, the O-ring 50 is placed not in an area in which the tip end-oriented inclined face 28 is formed, but in that which is approximately parallel to the axis O, whereby airtightness due to the O-ring 50 can be sufficiently maintained. This configuration is particularly effective in the case where the tip end face of the insulating member 40 forms an end face oriented in the direction of the axis O.

Preferably, the smallest-diameter portion 27 which functions as the stress releasing portion is formed on the tip end side with respect to a point C which is the midpoint between a tip end portion A of the center pole 20 in the direction of the axis O, and a portion B which is in contact with the O-ring 50. When a periodical load, i.e., vibrations due to an engine act on the center pole 20, the rear end portion (including the terminal portion) of the center pole 20 swings with using as the fulcrum the vicinity of the portion joined to the cylindrical member 21. At this time, stresses acting on the center pole 20 are concentrated in the vicinity of the fulcrum. Therefore, the effect of relaxing a stress in the mode where the smallest-diameter portion 27 is formed on the tip end side with respect to the point C as shown FIG. 6 is larger than that in a mode where the smallest-diameter portion 27 is formed on the rear end side with respect to the point C.

In FIG. 6, the smallest-diameter portion 27 is formed by a predetermined length so that the outer shape extends in parallel with the axis O. Alternatively, this length may be zero, and it is not always essential to have a predetermined length. Furthermore, it is not always necessary to form a tapered rear end-oriented inclined face between the center-pole front large-diameter portion 24 and the smallest-diameter portion 27. Of course, however, a tapered shape is preferable from the viewpoints of dispersion of a stress, easiness of the production process, etc.

In the case where the tip end-oriented inclined face 28 and the rear end-oriented inclined face 29 are provided, when an acute angle formed by the tip end-oriented inclined face 28 and the axis O is $\alpha$, and an acute angle formed by the rear end-oriented inclined face 29 and the axis O is $\beta$, a relationship of $\alpha<\beta$ is preferably satisfied. In FIG. 6 showing a glow plug having this configuration, the circle S indicates main portions in an enlarged manner. The enlarged view exaggeratingly shows the relationship between $\alpha$ and $\beta$ in order to clarify the relationship.

When the stress releasing portion is disposed in the center pole so as to satisfy the above relation, a stress acting on the center pole does not suddenly change because the tapered shape is formed. Since $\beta$ is larger than $\alpha$, the stress releasing portion is formed in a position closer to the tip end, and hence the ceramic heater can be prevented more effectively from being damaged.

The invention is not restricted to the above-described embodiment, and the spirit of the invention can be realized in various manners. It is not necessary that the stress releasing portion is provided by partly reducing the diameter of a large-diameter center pole, or forming a recess in the center pole. For example, a structure may be employed in which the portion on the rear end side with respect to the center-pole fitting portion is reduced in diameter, and the portion is elongated toward the rear end side while the diameter is maintained.

When the cylindrical member and the center pole is joined by laser welding, the center pole may be inclined. The disposition of the stress releasing portion is effective in correcting the inclination. The method of producing the glow plug is not restricted to laser welding because the effects of the invention can be attained as far as the stress releasing portion is formed in the center pole when the glow plug is completed.

According to the invention, in the embodiment and the modifications, a ceramic heater in which a conductive ceramic is embedded as a heating element in an insulative ceramic is used as the ceramic heater 30. Alternatively, a ceramic heater which houses a heating coil that generates heat upon energization may be employed, or the glow plug may use a ceramic heater of the surface heating type in which the surface is formed by a conductive ceramic. The invention relates to a center pole which performs a current supply in the range from a terminal on the rear end side of a glow plug to a heater on the tip end side. Paradoxically speaking, the invention does not relate to a shape of a heater nor to a type of heating. When the invention is applied to a ceramic heater in which a breaking resistance must be considered, the effects of the invention can be exerted more effectively.

Figure 9A:
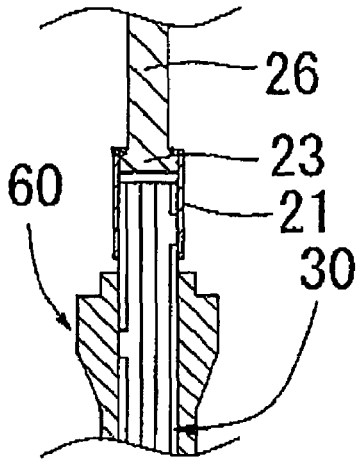
FIGS. 9A to 9D are enlarged sectional view of a center pole (heater connecting portion) in the glow plug of the invention, and showing modifications of the invention.
Figure 9B:
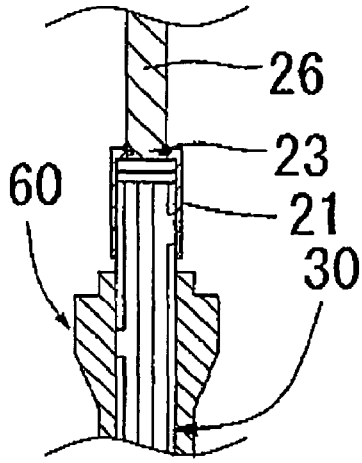

In addition to the embodiment and the modifications, the structure for connecting the center pole and the cylindrical member together may employ the configurations listed in FIGS. 9A to 9D. For example, FIG. 9A shows an example in which the tip end of the center pole that is made larger in diameter than the stress releasing portion so as to be approximately equal to the inner diameter of the cylindrical member is formed as a center-pole fitting portion, the center-pole fitting portion is pressingly inserted into the cylindrical member, and the laser welding is then conducted. FIG. 9B shows an example in which the diameter of the whole center pole elongating to the tip end is equal to that of the stress releasing portion, the rear end of the cylindrical member is formed into a lid-like shape having a hole at the center, the tip end of the center pole is pressingly inserted into the hole, and the laser welding is then conducted.

Figure 9C:
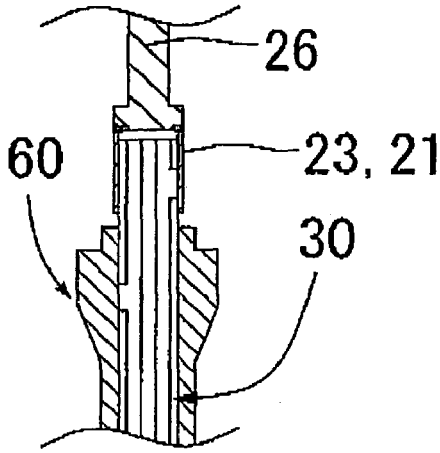
Figure 9D:
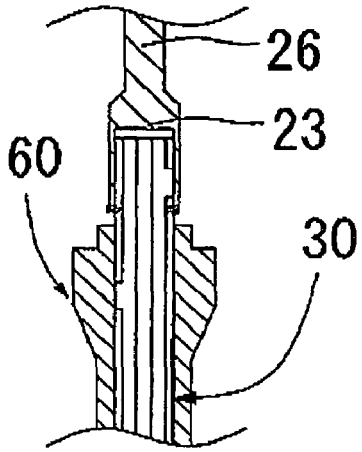

Examples of configurations which satisfy the second mode of the invention are an example shown in FIG. 9C in which the cylindrical member is welded to the tip end portion of the center pole having a diameter which is larger than the outer diameter of the cylindrical member, and that shown in FIG. 9D in which the cylindrical member is omitted, and, in place of the cylindrical member, a hole having an inner diameter that is substantially equal to the diameter of the rear end portion of the ceramic heater is formed in the tip end face of the center pole.

When any embodiment of FIGS. 9A to 9D is employed, a stress which acts on the ceramic heater in the case where the stress releasing portion is not disposed is equal to that acting in the case where the connection is made by the cylindrical member. When the stress releasing portion is formed in the center pole, therefore, it is possible to attain the effect of the invention that destruction, damage, and the like of the ceramic heater can be prevented from occurring.

This application is based on Japanese Patent application JP 2004-190821, filed Jun. 29, 2004, the entire content of which is hereby incorporated by reference, the same as if set forth at length.

What is claimed is:

1. A glow plug comprising:

a ceramic heater including a heating element provided in a tip wend side thereof, said heating element being capable of generating heat upon energization;

a cylindrical metal shell which has a shaft hole, which houses a rear end portion of said ceramic heater in said shaft hole, and which holds said ceramic heater in said shaft hole directly or via another member; and a coaxial center pole including:

a terminal portion provided in a rear end of said center pole, said terminal portion being supplied with electric power from outside directly or via another member;

a heater connecting portion having a hole provided in a tip end of said center pole, a rear end portion of said ceramic heater being mechanically rigidly fitted into said hole; and a stress releasing portion having the smallest diameter in an area between said heater connecting portion and said terminal portion.

2. The glow plug as claimed in claim 1, wherein said heater connecting portion comprises:

a cylindrical member; and a center-pole filling portion fitted into said cylindrical member.

3. The glow plug as claimed in claim 1, wherein the center pole comprises a center-pole front large-diameter portion provided in an area between said heater connecting portion and said stress releasing portion, said center-pole front large-diameter portion having a larger diameter than that of said stress releasing portion.

4. The glow plug as claimed in claim 2, wherein said center pole comprises:

a center-pole front large-diameter portion having a larger diameter than that of said center-pole fitting portion, and a positioning end face, against which a rear end face of said cylindrical member buffs, provided between said center-pole front large-diameter portion and said center-pole fitting portion.

5. The glow plug as claimed in claim 4, wherein said cylindrical member includes a portion which is adjacent to said center-pole front large-diameter portion, the portion having an outer diameter substantially equal to that of said center-pole front large-diameter portion.

6. The glow plug as claimed in claim 2 wherein an outer diameter of said cylindrical member is substantially uniform along an axial direction.

7. The glow plug as claimed in claim 1, wherein said stress releasing portion is provided on a tip end side with respect to a midpoint in an axial direction of said center pole.

8. The glow plug as claimed in claim 1, wherein said center pole comprises a tip end-oriented inclined face which is adjacent to a rear end side of said stress releasing portion, and in which a diameter is more increased as further advancing toward a rear end of an axial direction.

9. The glow plug as claimed in claim 1, wherein said center pole comprises a rear end-oriented inclined face which is adjacent to a tip end side of said stress releasing portion, and in which a diameter is more increased as further advancing toward a tip end of an axial direction.

10. The glow plug as claimed in claim 1, wherein said center pole comprises: a tip end-oriented inclined face which is adjacent to a rear end side of said stress releasing portion, and in which a diameter is more increased as further advancing toward a rear end of an axial direction; and a rear end-oriented inclined face which is adjacent to a tip end side of said stress releasing portion, and in which a diameter is more increased as further advancing toward a tip end of an axial direction.

11. The glow plug as claimed in claim 10, wherein, when an acute angle formed by said tip end-oriented inclined face of said center pole with respect to an axis of the center pole is $\alpha$, and an acute angle formed by said rear end-oriented inclined face of said center pole with respect to said axis is $\beta$, a relationship of $$\alpha<\beta$$

is satisfied.

12. The glow plug as claimed in claim 8, wherein said glow plug comprises an O-ring fitted between an outer circumferential face of said center pole and an inner circumferential face of said metal shell, and said 0-ring is provided on a rear end side with respect to said tip end-oriented inclined face.

* * * * *